US006885272B1

(12) United States Patent
Piaskowski et al.

(10) Patent No.: US 6,885,272 B1
(45) Date of Patent: Apr. 26, 2005

(54) PERMANENT MAGNETIC CORE DEVICE

(75) Inventors: Andrew D. Piaskowski, St-Lazare (CA); Vladimir Glavac, Pincourt (CA)

(73) Assignee: Delta Group Xfo Inc., Boucherville (CA)

( * ) Notice: Subject to any disclaimer, the term of this patent is extended or adjusted under 35 U.S.C. 154(b) by 0 days.

(21) Appl. No.: 09/806,067

(22) PCT Filed: Sep. 29, 1998

(86) PCT No.: PCT/CA98/00921

§ 371 (c)(1),
(2), (4) Date: Mar. 23, 2001

(87) PCT Pub. No.: WO00/19458

PCT Pub. Date: Apr. 6, 2000

(51) Int. Cl.[7] ..... H01F 21/00
(52) U.S. Cl. ..... 336/110; 336/178
(58) Field of Search ..... 336/83, 110, 178, 336/210–221, 233–234

(56) References Cited

U.S. PATENT DOCUMENTS 4,675,615 A * 6/1987 Bramanti ..... 330/8
5,821,844 A * 10/1998 Tominaga et al. ..... 336/110
5,926,083 A * 7/1999 Asaoka ..... 336/110

* cited by examiner

*Primary Examiner*—Tuyen T Nguyen
(74) *Attorney, Agent, or Firm*—Olson & Hierl, Ltd.

(57) ABSTRACT

Biased core devices and method of use are disclosed in which magnetic core energy losses due to hysteresis and eddy currents are greatly reduced in comparison to the core losses in prior art transformers and inductive devices. The present invention sets forth a transformer or choke device in which permanent magnets are surrounded by electrical steel materials and may be held in place by pole pieces. The magnetic core transformer structure also permits a method of use in which current passing through the device is controlled by the field strength of the permanent magnets. In addition, the biased magnetic core transformer operation may be linear or non-linear, and placed in series or parallel within a circuit. The magnetic components disclosed in the present invention affords both energy loss reductions and size reductions in comparison to known prior art transformers. The invention has many applications, including, but not limited to, the protection of switch gear, current limiting, voltage transformation in power distribution and for current control in arc discharge lamp circuits.

16 Claims, 11 Drawing Sheets

ORTHOGONAL CONTRUCTION OF MAGNECORE ASSEMBLY

FIGURE 1 ORTHOGONAL CONTRUCTION OF MAGNECORE ASSEMBLY
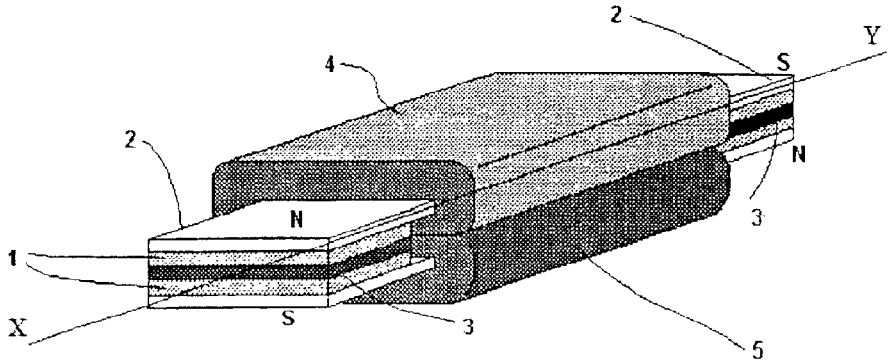
FIGURE 2 GEOMETRIC PARAMETERS OF AN ORTHOGONAL MAGNECORE ASSEMBLY
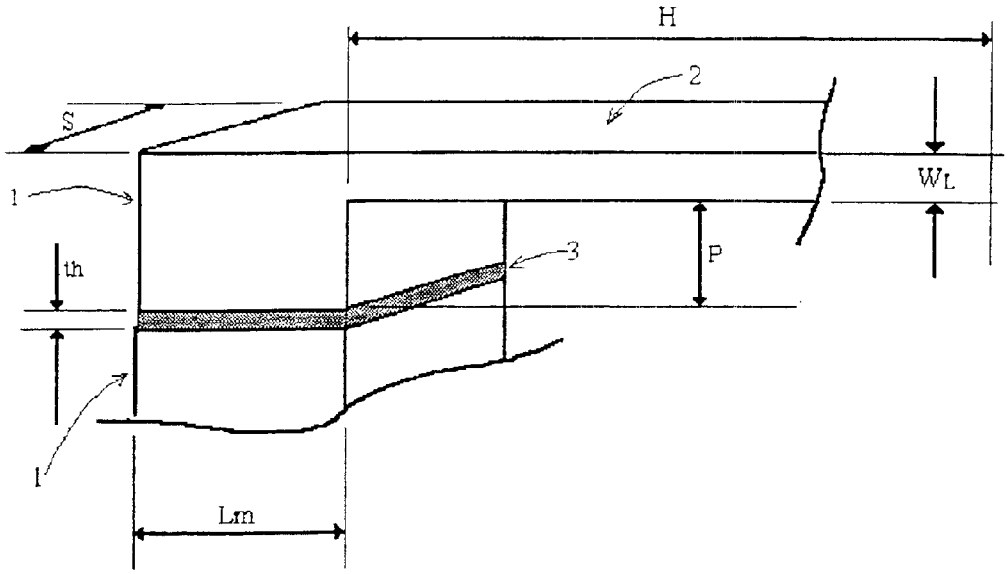

FIGURE 3 TOROIDAL FORM OF MAGNECORE WITH 2 POLE PIECES
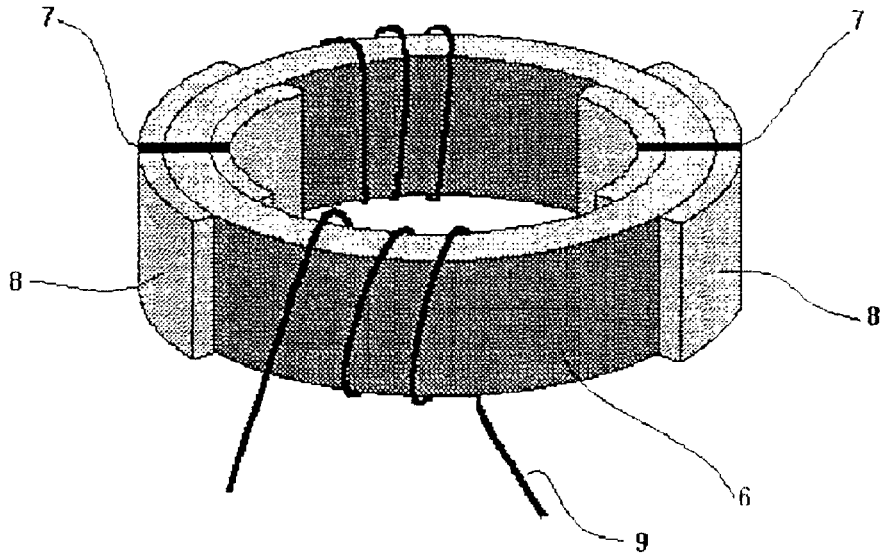
FIGURE 4 TOROIDAL FORM OF MAGNECORE WITH SKEWED MAGNETS
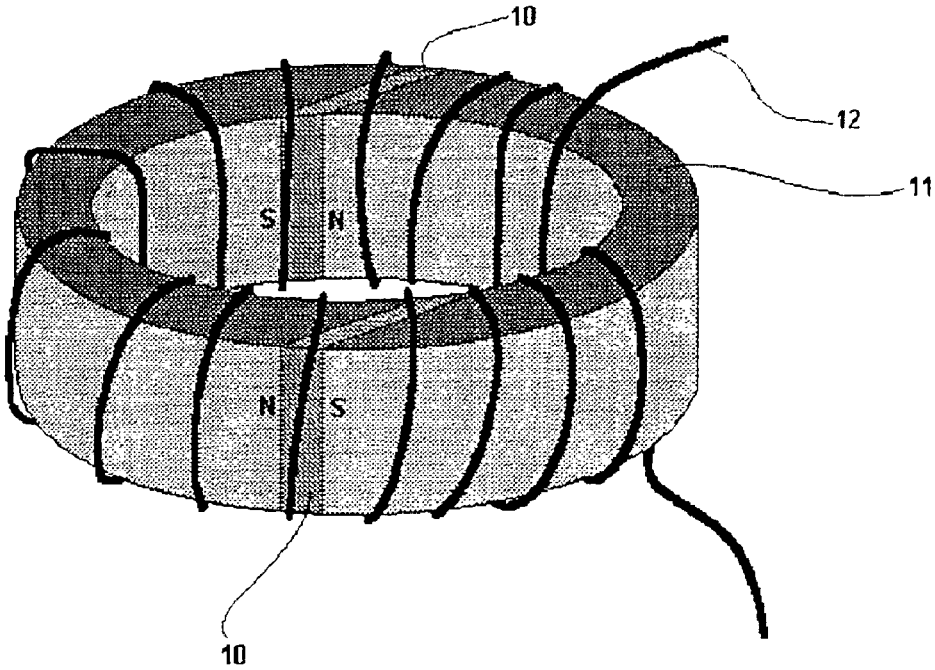

FIGURE 5 TYPICAL INDUCTANCE CHARACTERISTIC OF SATURATED TYPE MAGNECORE
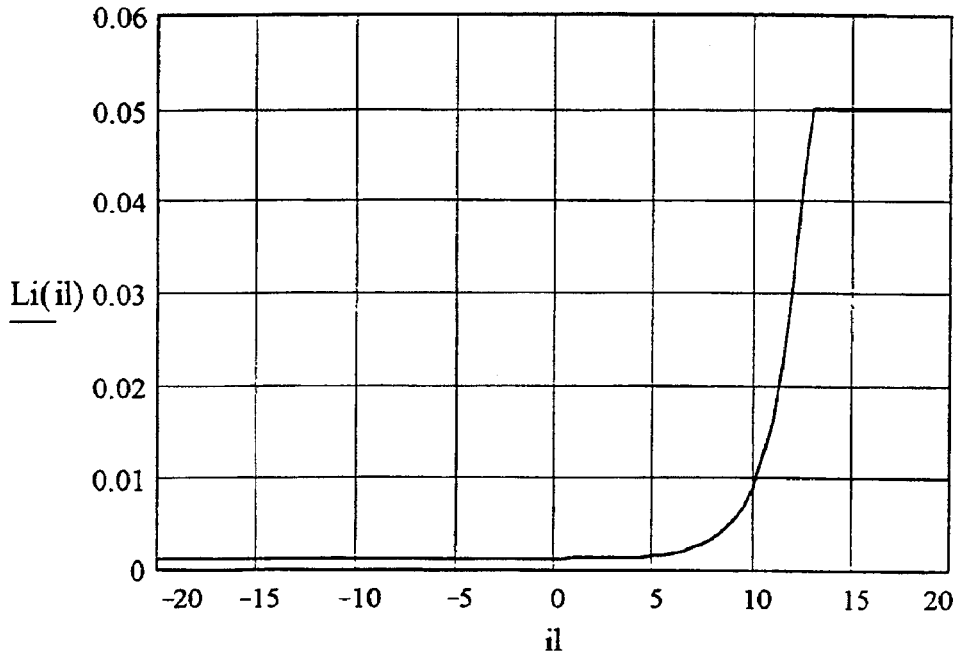
FIGURE 6 INDUCTIVE CHARACTERISTICS OF TWO 'ANTI-PHASE" CONNECTED MAGNECORES
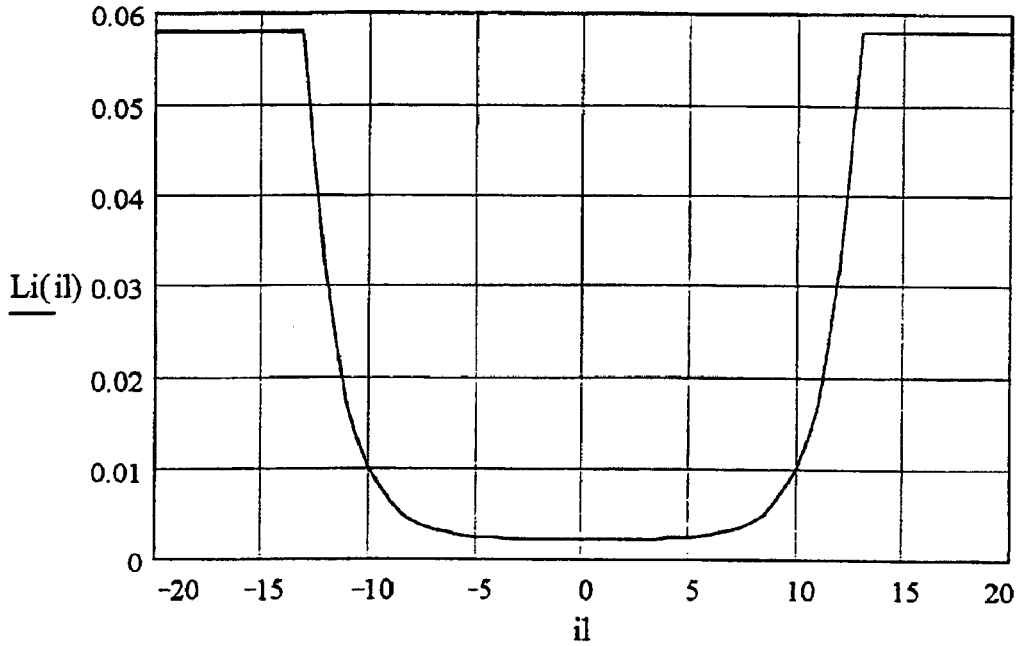

FIGURE 7 QUASI SQUARE CURRENT WAVEFORM PRODUCED WHEN MAGNECORES ARE CONNECTED AS IN FIG. 8 WITH CHARACTERISTICS OF FIG. 6
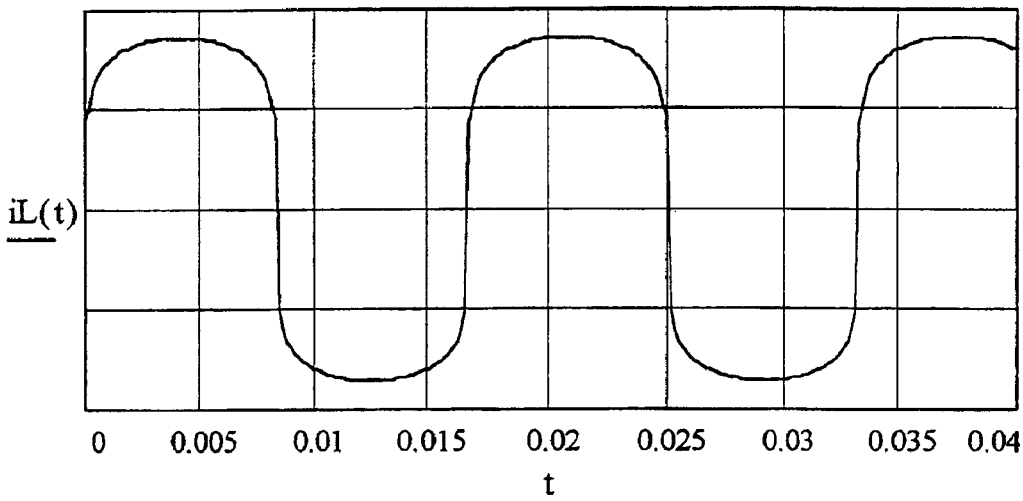
FIGURE 8 CURRENT REGULATION CONFIGURATION OF MAGNECORE ASSEMBLIES
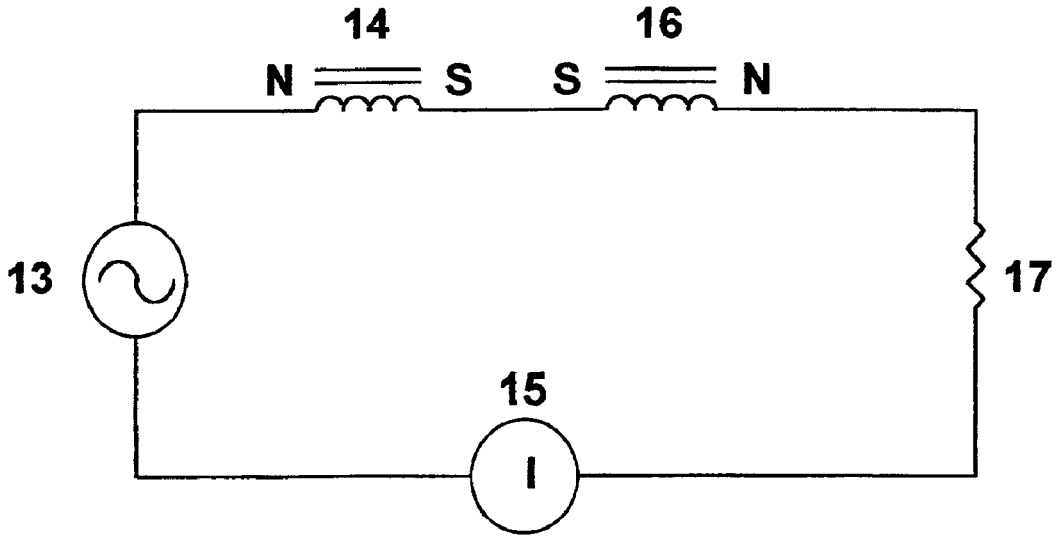

FIGURE 9 INTERNAL FLUX DISTRIBUTION OF SATURATED MAGNECORE DEVICE
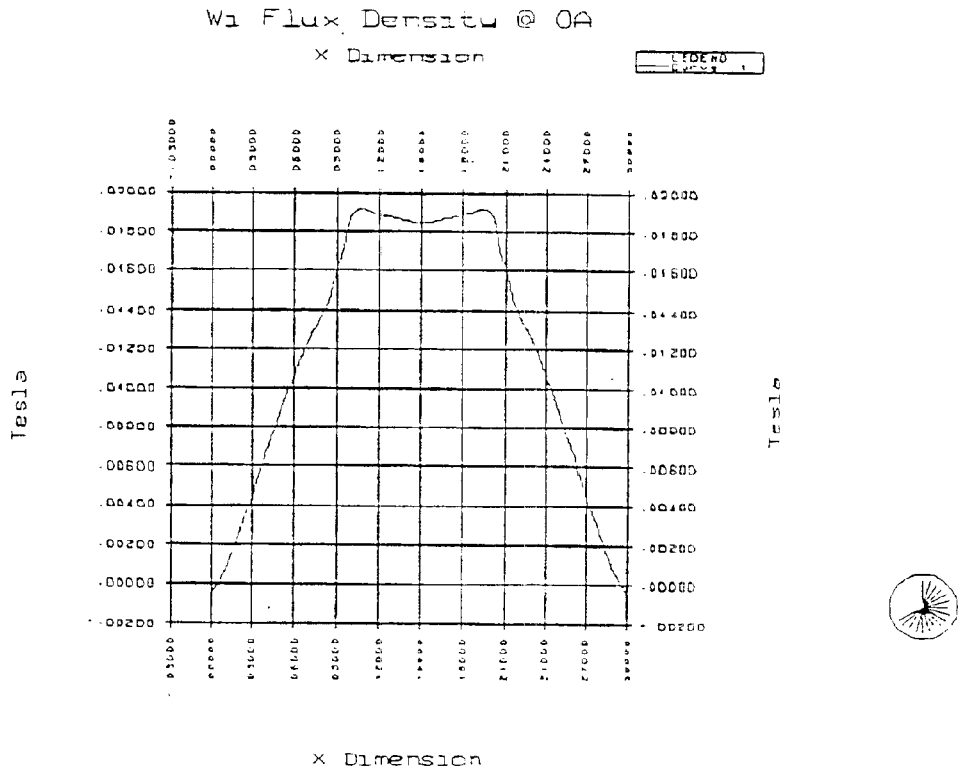

FIGURE 10 INTERNAL FLUX DISTRIBUTION OF DE-SATURATED MAGNECORE DEVICE
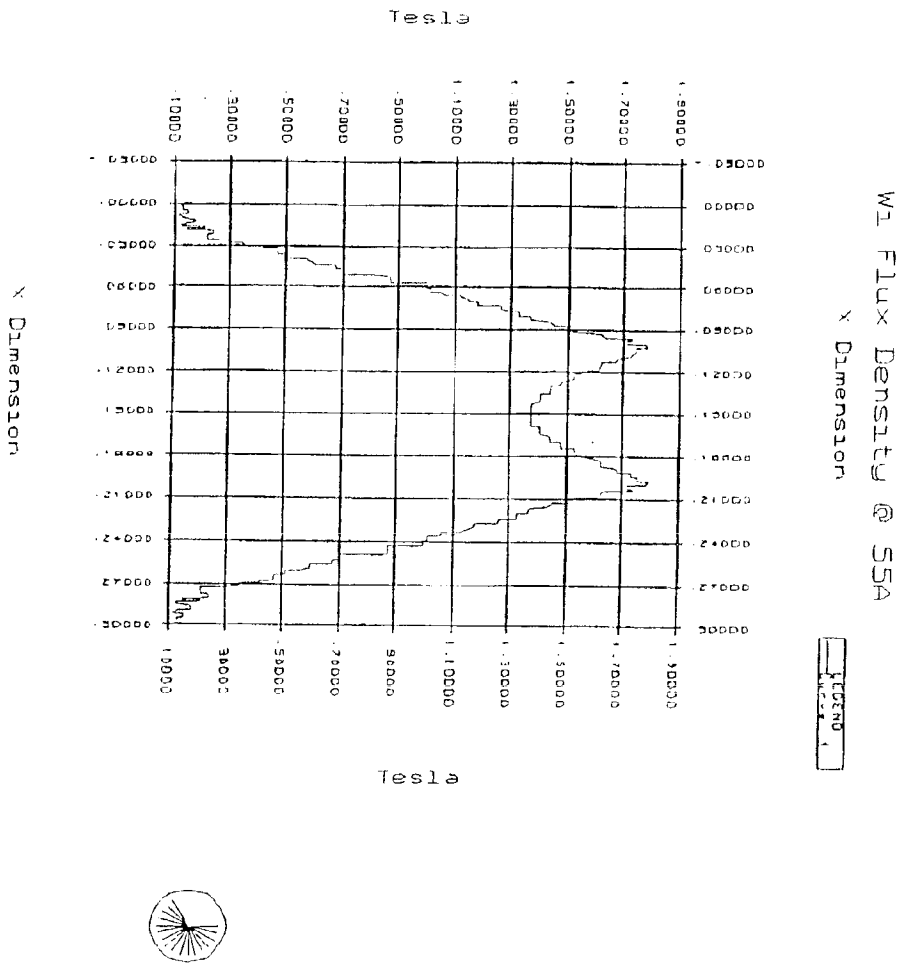

FIGURE 11 B-H HYSTERISIS OPERATING POINT OF FIRST MAGNECORE ASSEMBLY WHEN IN CONFIGURATION OF TWO
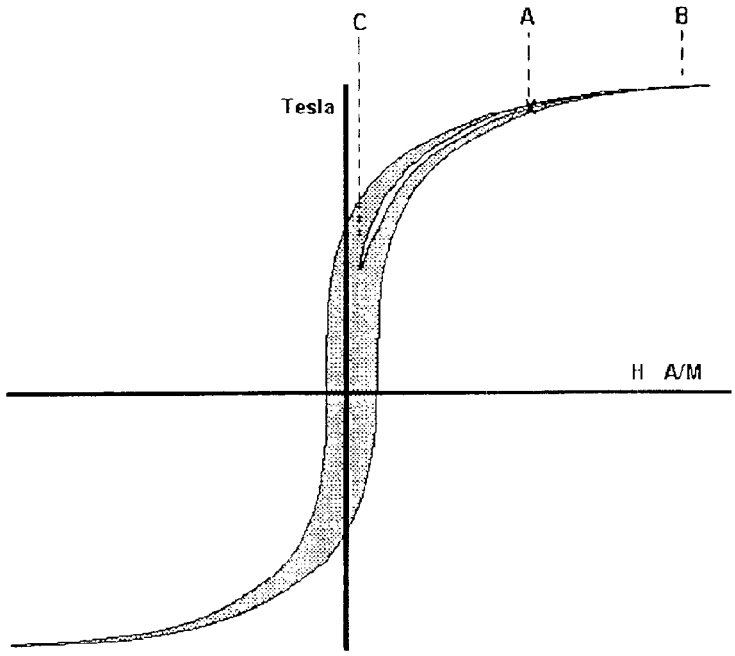
FIGURE 12 B-H HYSTERISIS OPERATING POINT OF SECOND MAGNECORE ASSEMBLY WHEN IN CONFIGURATION OF TWO
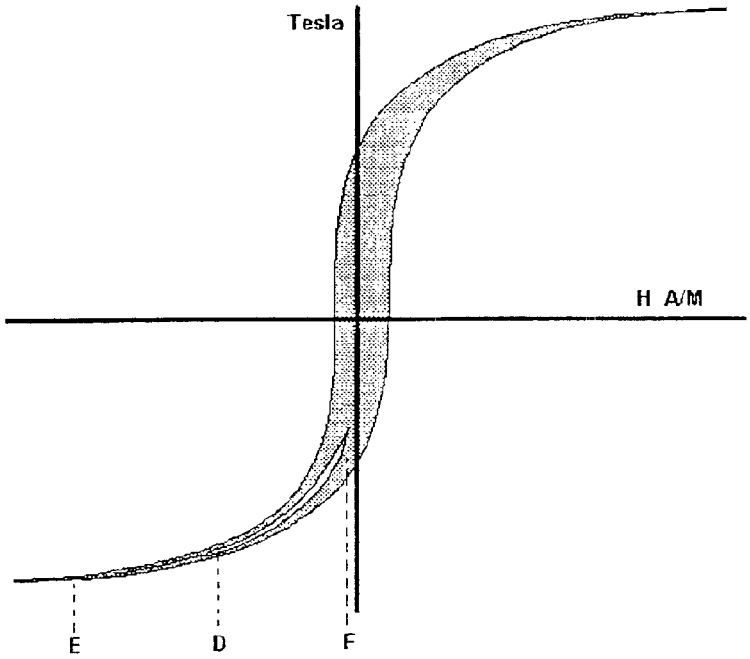

FIGURE 13 EFFECTIVE B-H CHARACTERISTIC OF A CONFIGURATION OF TWO MAGNECORE ASSEMBLIES
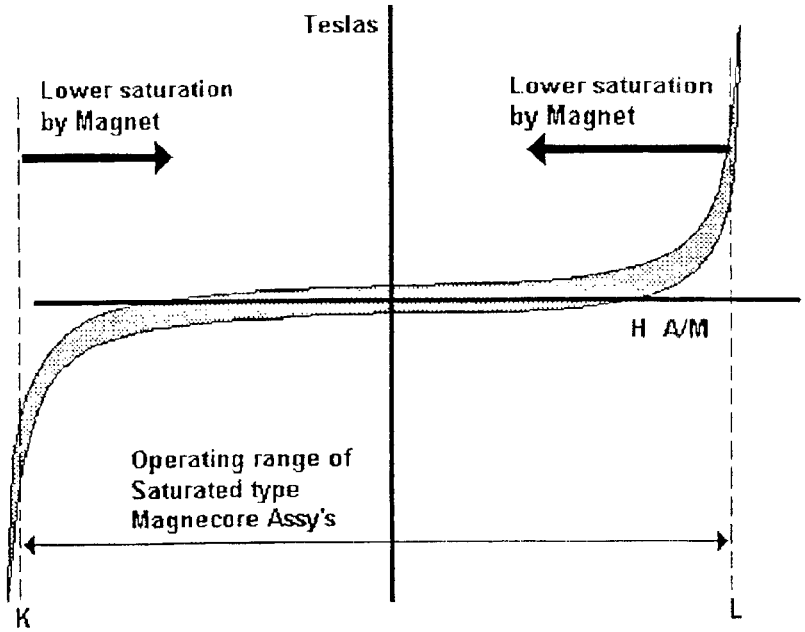
FIGURE 14 EFFECTIVE B-H CHARACTERISTIC OF DESATURATED CONFIGURATION OF TWO MAGNECORE ASSEMBLIES
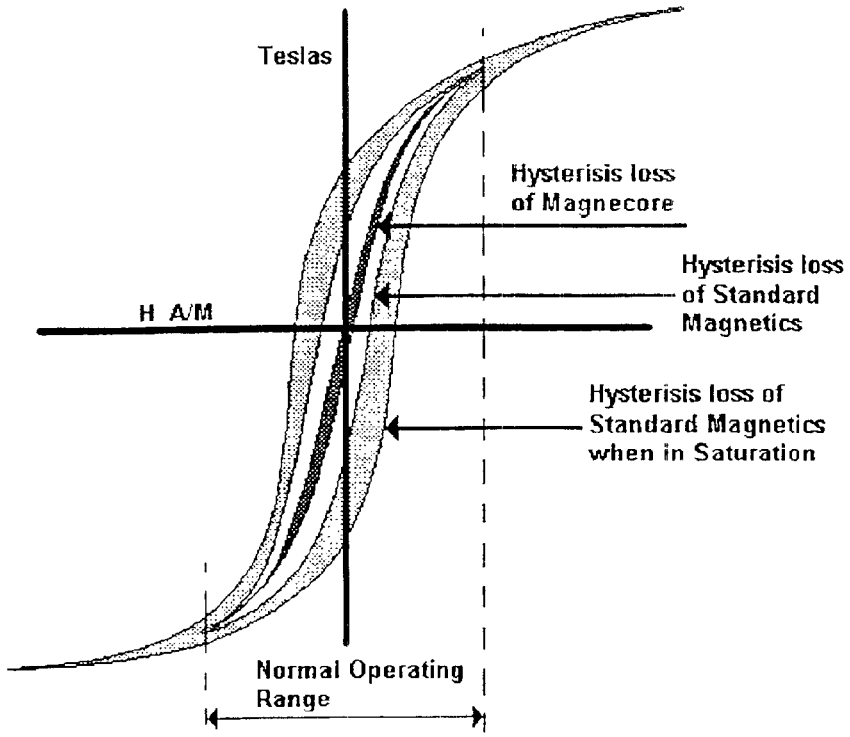

FIGURE 15 THREE-PHASE MAGNECORE CONSTRUCTION EXAMPLE
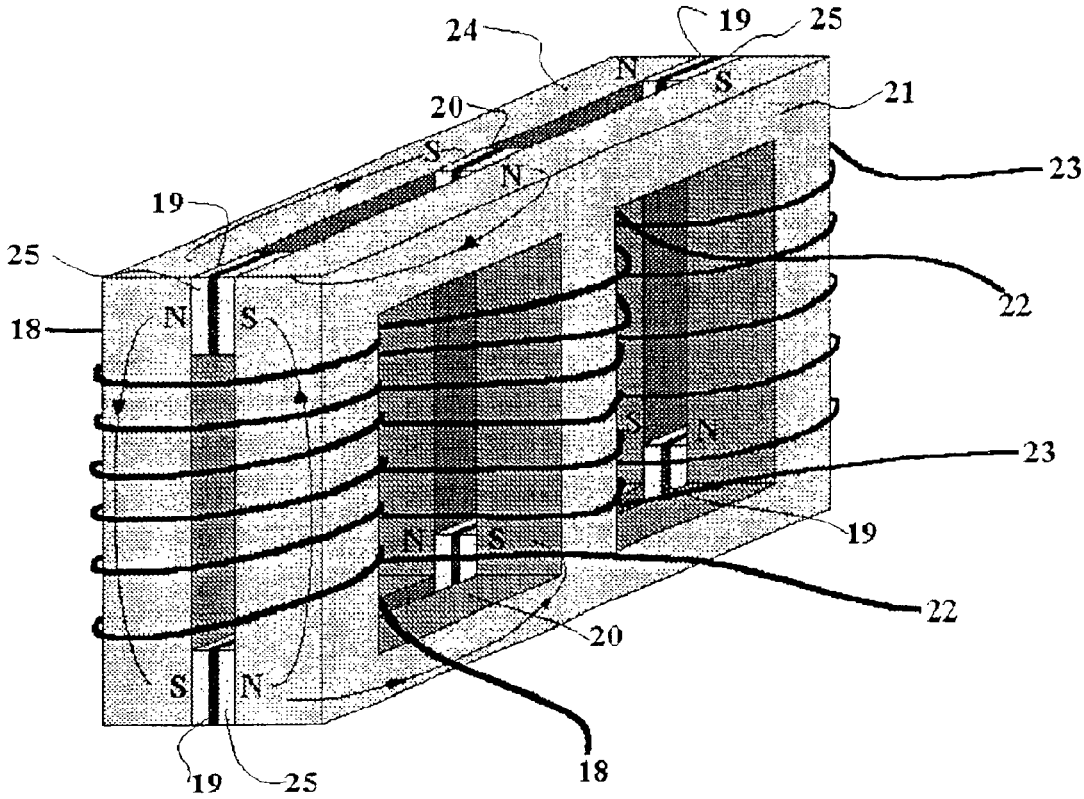

PERMANENT MAGNETIC CORE DEVICE

FIELD OF THE INVENTION

The present invention relates to the field of magnetic inductors or transformers and, in particular, relates to an inductor or transformer with a permanent magnetic core or biased core technology.

BACKGROUND OF THE INVENTION

Magnetic amplifiers have been well known in the art for use in power control systems. Magnetic amplifiers rely on the fact that magnetic fields or magnetic bias are created in the magnetic circuits of inductive power components so as to effect the control of current or power. It is known in the prior art to construct magnetic inductors containing an iron core, such as disclosed in U.S. Pat. Nos. 4,103,221 and 4,009,460, both to Fukui et al. However, when an inductor utilizes a ferromagnetic core for example, the core is readily capable of reaching magnetic saturation, due to DC electric current, resulting in a reduction of the inductance. To avoid these saturation problems, Fukui et al. proposes to utilize permanent magnetic cores for the inductors, with such cores producing a permanent biasing magnetic field. By doing so, the core of the inductor is less likely to suffer magnetic saturation and has an extended range of useful inductance. However, the devices as described by Fukui et al. form a solid core structure, and are thus still heavy and are not well adapted for devices where a reduction of weight is critical. In addition, the devices of Fukui generally do not maintain a precise and steady level of flux density or saturation, throughout a wide range of DC current. Furthermore, the device of Fukui are specifically designed for DC current applications, and do not appear to be effective in AC current applications.

In addition, magnetic devices such as transformers, chokes and inductors commonly used silicon grade steel for the magnetic core and copper or aluminum for the windings. Over the last decades, this technology has not progressed but improvements have been made in materials and processes for the constructions of such transformers. However, a need still remains for magnetic technology with reduced energy loss characteristics, reduced weight and lower cost. A need also exists for energy efficient and cost efficient transformers which can be utilized in high power consumption circuits, such as ballasts for street lighting and are discharge lamp applications, or circuits used in current, power control and distribution.

SUMMARY OF THE INVENTION

It is a feature of the present invention to provide inductor devices which are highly energy efficient and produce low amounts of heat.

It is another feature of the present invention to provide inductor devices which are lightweight and compact.

It is a further feature of the present invention to provide an inductor device which can be used in a variety of different applications, such as a transformer, current controller, or as a power equipment protection device.

According to the above features, from a first broad aspect, the invention provides a permanent magnetic core device for use as a transformer, inductor, choke, or a component in a current limiting circuit, CHARACTERIZED BY:

first and second layers of magnetic conductive material (2) retained in a predetermined, spaced apart relationship with respect to one another, so as to define opposed facing surfaces at least at first and second end portions thereof, a gap defined between said layers;

a first permanent magnetic piece (3) located at said first end portion between said first and second layers of ferromagnetic material, and a second permanent magnetic piece (3) located at a second end portion between said first and second layers of magnetic conductive material, the first and second permanent magnetic pieces being placed so that their fields are additive;

coil means surrounding each of said first and second layers of magnetic conductive material, said coil means extending within said gap between said first and second permanent magnetic pieces and being placed so that fields produced by the coil means are additive.

In accordance with a second broad aspect, the invention provides a toroidal permanent magnetic core for use as a transformer, choke or component in a current limiting circuit, CHARACTERIZED BY:

a first semi-circular toroidal ferromagnetic piece (6) having first and second ends;

a second semi-circular toroidal ferromagnetic piece (6) having first and second ends;

said first and second ends of said first toroidal ferromagnetic piece being arranged to face the first and second ends of said second toroidal ferromagnetic piece, such that the ends of said first and second toroidal pieces are opposed and spaced apart;

permanent magnetic means (7) interposed between said ends of said toroidal ferromagnetic pieces and joined with said toroidal ferromagnetic pieces;

a coil (9) surrounding a portion of said first toroidal ferromagnetic piece or said second toroidal ferromagnetic piece, said first and second toroidal ferromagnetic pieces and said permanent magnetic pieces defining a closed toroidal structure.

In accordance with a third broad aspect, the invention provides a multi-phase electrical device for use as a power distribution transformer, a power distribution protection device or a current limiting device, CHARACTERIZED BY:

a first core structure (21) and a second core structure (24), each of said first core structure and second core structure having a perimeter and at least one vertical limb extending within said perimeter of each core structure;

said first and second core structures being retained in juxtaposition by permanent magnet sets (19, 20) interposed between said first and second core structures; and coils (18, 22, 23) surrounding at least a portion of said perimeter, and surrounding at least a portion of said at least one vertical limb;

wherein said first and second frames and permanent magnet sets form a unit.

BRIEF DESCRIPTION OF THE DRAWINGS

The preferred embodiments of the present invention will now be described with reference to the accompanying drawings in which FIG. 1 illustrates a perspective view of the preferred magnetic core device of the present invention.

FIG. 2 illustrates geometrical parameters of the preferred magnetic core device of the present invention, which parameters are utilized in Equations 1–3, described in the Detailed Description of the Invention.

FIG. 3 illustrates a perspective view of an alternative embodiment of the magnetic core device.

FIG. 4 illustrates a second alternative embodiment of the magnetic core device.

FIG. 5 illustrates a plot of inductance versus current for the embodiment of FIG. 1 in a flux saturated condition.

FIG. 6 illustrates a plot of inductance versus current in a circuit with two magnetic core devices placed in an "Anti-Phase" connection, where the polarities of the two core devices are opposed.

FIG. 7 illustrates a plot of current versus time in a circuit where the magnetic core devices are placed in the Anti-phase connection.

FIG. 8 illustrates a schematic circuit diagram where magnetic core devices are placed in Anti-phase connection, and which produces the current waveform shown in FIG. 7.

FIG. 9 illustrates a plot of magnetic flux density over the length of the magnetic core assembly, along the line X-Y in FIG. 1, and at zero current flow.

FIG. 10 illustrates a plot of flux density over the length of the magnetic core assembly, along line X-Y in FIG. 1, and where the current running through the coils of the circuit are creating a field which opposes the field of the permanent magnets.

FIG. 11 illustrates a hysteresis curve plotting magnetic flux density versus field strength and which further illustrates the static and dynamic operating points of a saturated magnetic core device 14 of FIG. 8.

FIG. 12 illustrates a hysteresis curve plotting magnetic flux density versus field strength and which further illustrates the static and dynamic operating points of a flux saturated magnetic core device 16 of FIG. 8.

FIG. 13 illustrates an effective hysteresis curve plotting magnetic flux density versus field strength for the combined operation of the two flux saturated magnetic core devices in FIG. 8.

FIG. 14 illustrates hysteresis curves plotting magnetic flux density versus field strength for a standard inductor, choke or transformer, wherein the magnetic core device of the present invention is operated at non-flux saturated conditions.

FIG. 15 illustrates an application of a three-phase transformer in which the operating conditions of FIG. 14 are applicable.

FIG. 17 illustrates an alternate embodiment of the invention which utilizes the principles illustrated in FIG. 16.

DETAILED DESCRIPTION OF PREFERRED EMBODIMENTS

Figure 16:
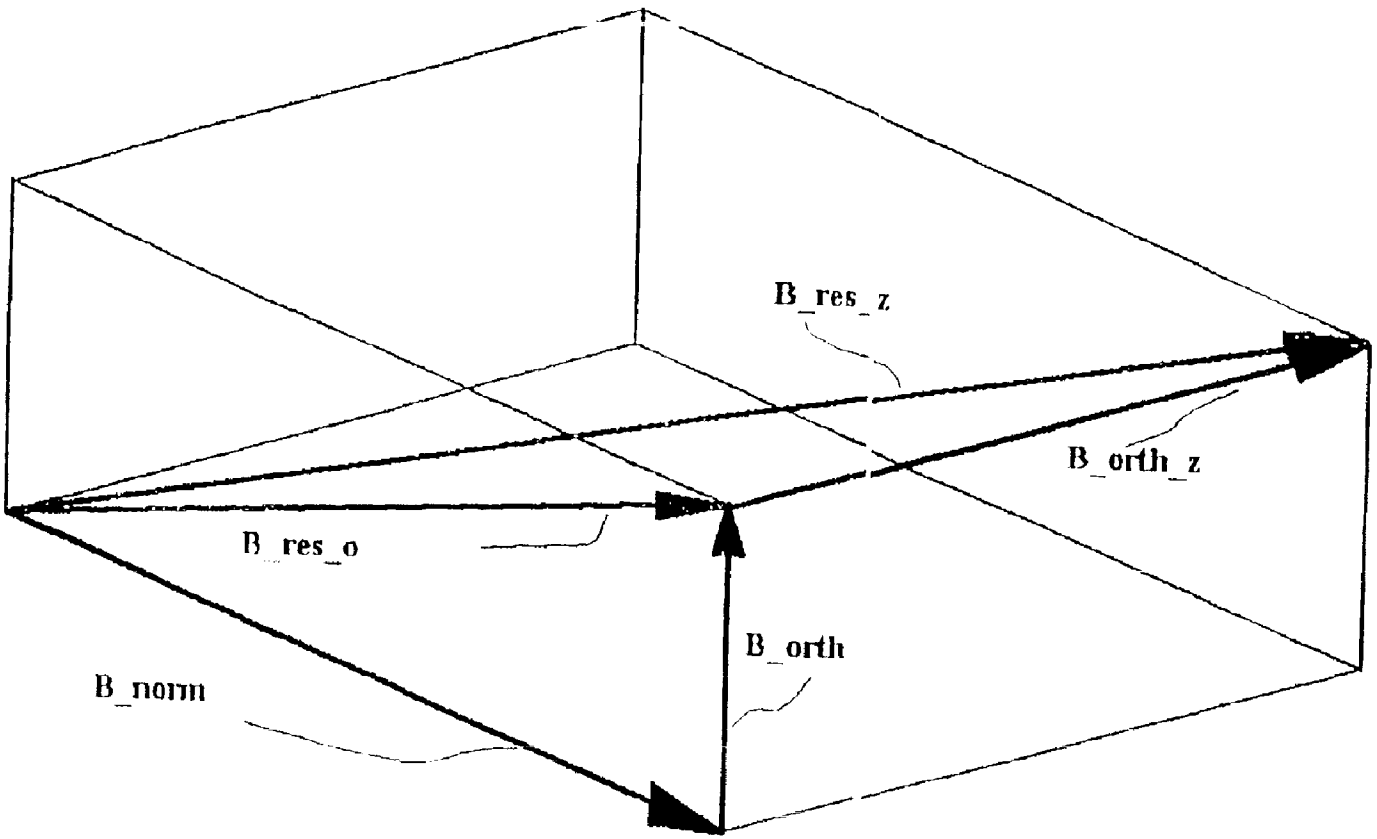
FIG. 16 illustrates a vector diagram for showing flux vectors that would be established for an embodiment having reduced hysteresis losses.
Figure 16:
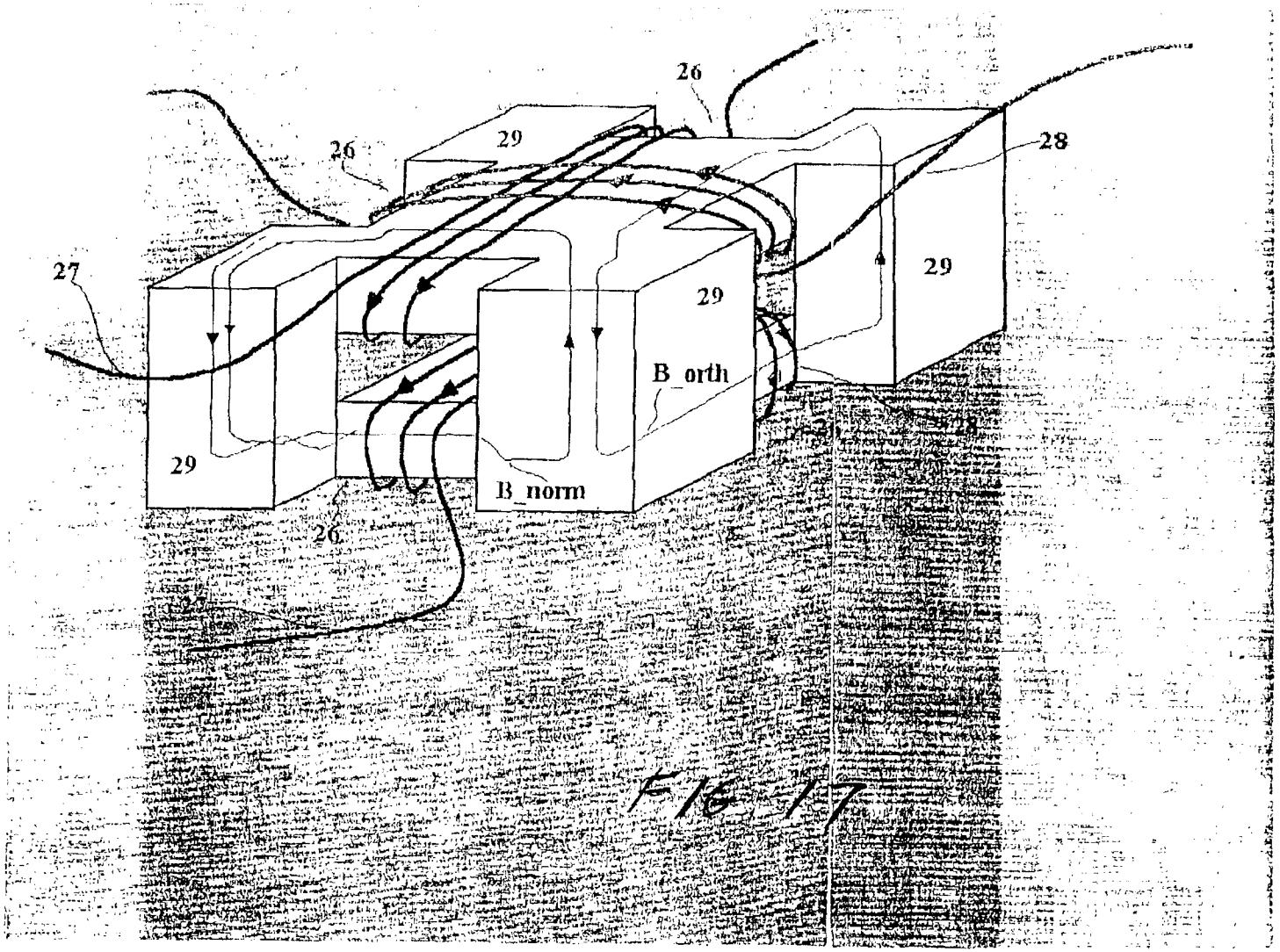

FIG. 1 shows a perspective view of a preferred embodiment of the permanent magnetic core device of the present invention. This device includes two coils 4, 5 wrapped around layers of magnetically-conductive steel material 2, forming a ferromagnetic core. Permanent magnetic pieces 3 are placed at opposing ends of the assembly. However, it may be desirable in certain applications to utilize only one magnet in the magnetic core device. To couple the magnetic pieces. 3 to the ferromagnetic layers 2, magnetic pole pieces may be utilized in layers positioned between the magnetic pieces 3 and the ferromagnetic layers 2. The magnets 3 are placed in such a manner that their fields are additive. The coils are positioned between the magnetic pieces 3 and the ferromagnetic layers 2. The magnets 3 ar placed in such a manner that their fields are additive. The coils are also placed so that the fields produce by the coils are additive. The present device can be utilized as a transformer, inductor, choke, or in a current limiting circuit as well. In comparison to known prior art transformers and inductors, the device of the present invention is lighter, and has lower demonstrated hysteresis losses in AC circuit application.

Theory Supporting Use of Permanent Magnetic Core Device as Current Controller

The permanent magnetic core device of the present invention can also the utilized as a current controlling device, and this application can be theoretically demonstrated. Reference is made to FIG. 2 which illustrated the various dimensions of the device in FIG. 1. The thickness of the permanent magnet 3 is designated by "th". The length of the permanent magnet is illustrated by "Lm". The depth dimension of the permanent magnet is "S" and the distance of the lower surface of the magnet to the lower surface of the ferromagnetic layer 2 is designated by "P". The ferromagnetic layer 2 has a thickness "$W_i$", and a coil winding length "Il". Accordingly, the maximum theoretical flux density of the device will be defined by:

$$Hm = \frac{Npls\ \ Hm \cdot th \cdot \mu o}{\left(\frac{H \cdot Lm}{\mu r \cdot Wi}\right) + Npls \cdot th} \tag{1}$$

Where "Hm" is the magnetic field strength, "Npls" is the number of poles, "H" is the coil winding length as illustrated in FIG. 2. "th" is the magnet thickness illustrated in FIG. 2, "Lm" is the length of the magnet illustrated in FIG. 2, "$\mu$o" is the permeability of free space and "$\mu$r" is the permeability of the ferromagnetic core layers 2.

If a field is applied opposing the magnets by the coils 4 and 5 of FIG. 1 of turns N, and current 1, then the residual flux density in the magnets will be given by:

$$Br = \frac{(Npls \cdot Hm \cdot th - N \cdot I) \cdot \mu o}{\left(\frac{H \cdot Lm}{\mu r \cdot Wi}\right) + Npls \cdot th} \tag{2}$$

Since the flux density in the ferromagnetic core is related to the magnetic residual flux density "Br" by the ratio Lm/W, the ferromagnetic core saturation flux density can be approximated by:

$$Bs = \frac{(Npls \cdot Hm \cdot th - N \cdot I) \cdot \mu o}{\left(\frac{H \cdot Lm}{\mu r \cdot Wi}\right) + Npls \cdot th} \cdot \left(\frac{Lm}{Wi}\right) \tag{3}$$

If the value "Bs" is greater than the value required to saturate the core Bsat, then the inductance of the permanent magnetic core assembly will be minimal, as the current I in coils 4, 5 of FIG. 1 is increased to the point where the core desaturates, then the inductance of the permanent magnetic core will maximize. Thus, equation (3) demonstrates that for the saturation mode of the permanent magnetic core device, this device operates as a controller of current. In AC circuits, the maximum inductance value will form a high impedance to current, while the minimal inductance will form a low impedance to current.

Characteristics of Permanent Magnetic Core Device FIG. 5 illustrates the variations of inductance against current on the device of FIG. 1 in the magnetic flux saturated condition. As the current changes from the negative to the positive direction, the inductance suddenly increases to a constant, steady level. With this sudden change in inductance, the impedance to change in current will also increase, and thus the device will serve as a predictable controller of current.

If two of the permanent magnetic core devices of FIG. 1 are joined in series together, they can produce a system which will provide excellent control over current in AC applications. FIG. 8 illustrates a simple circuit diagram where two permanent magnetic core devices, such as those shown in FIG. 1, are joined together with repelling poles facing each other. The transformer device in FIG. 15 may also be used in three phase application, whereby the characteristics shown in FIG. 6 would be applicable per phase. The two permanent magnetic core devices are illustrated as 14 and 16 in FIG. 8, and are connected to an AC voltage source 13, a resistance load 17, and a third structure which could be, for example, a lamp or current monitoring device 15. The operating characteristics of this circuit are illustrated in FIGS. 6 and 7. FIG. 6 illustrates changes in inductance versus current and shows the sudden increase in inductance at both negative and positive current directions. These changes in inductance translate into changes of impedance which control the current in the circuit. The actual appearance of the electrical current waveform is illustrated in FIG. 7, which plots current versus time, and demonstrates that the electrical current waveform in the system of FIG. 8 is nearly square. The actual "squareness" of the waveform will depend upon the geometry of the permanent magnetic core devices employed, and other geometries for the permanent magnetic core device are illustrated in FIGS. 3, 4 and 15, which will be discussed in more detail in a later section. Thus, the permanent magnetic core device, whether it is used alone or in a circuit with several such devices, effectively serves as a controller of current.

FIGS. 9 and 10 illustrate the distribution of magnetic flux across the length of the ferromagnetic core in the permanent magnetic core device of FIGS. 1 and 2. In FIGS. 9 and 10, the length dimension on the horizontal axis is the dimension H from FIG. 2, shown in centimeters. The vertical axis is flux density in Teslas. FIG. 9 illustrates the condition where the core of the device is flux saturated, while FIG. 10 illustrates the core of the device in a de-saturated condition. The saturated condition is created when no current flows through the device, while the desaturated condition occurs when a current opposing the magnetic field strength flows through the device.

FIGS. 11 and 12 illustrate the hysteresis curves which are individually created by the devices 14 and 16 respectively in FIG. 8. The hysteresis curve illustrates magnetic flux density against field strength. In FIG. 11, the operating point A is well into the saturation region for the core, and represents the field produced by the magnets. If the current flow in the coils aids the magnetic field of the permanent magnets, then the operating point will move towards point B. If the current flow in the coils opposes the magnetic field of the permanent magnets, then the operating point will move towards point C. Point C is in the non-saturated area of the hysteresis curve. At this point, the inductance of the permanent magnetic core device is high. In FIG. 12, the operating point E represents the device 16 in its saturated condition, while points D and F show the operating point moving towards the unsaturated condition.

FIGS. 13 and 14 illustrate the combined hysteresis characteristics of the two permanent magnetic core devices in FIG. 8, or in the alternate embodiment of FIG. 15 which will be later described. The characteristics of each permanent magnetic core device are combined to produce these diagrams of effective characteristics. FIG. 13 shows the combined hysteresis characteristics when the two permanent magnetic core devices are flux saturated when no current flows, while FIG. 14 shows the combined characteristics in a less saturated condition. As can be readily observed from these diagrams, the combined effects of the two permanent magnetic core devices produces a hysteresis curve with an extremely narrow area. Since the area of hysteresis curve represents energy lost by the operation of the device, it can be readily seen that a circuit utilizing biased core technology of the preferred embodiment from FIG. 1 (or later described alternate embodiment of FIGS. 3, 4 and 15) produces energy losses that are much lower than the energy losses experienced by conventional magnetic devices. Such reductions in energy losses translate in a reduction of heat and lower operating costs when the permanent magnetic core devices are utilized in a circuit.

Alternate Embodiments of the Invention

FIGS. 3 and 4 illustrate the alternative embodiments for the permanent magnetic core device. In FIG. 3, the permanent magnets 7 are aligned in a plane. Surrounding the magnets are a toroidal ferromagnetic core 6 and pole pieces 8 attached to the internal and external peripheries of the ferromagnetic core 6. A coil 9 is wrapped around the ferromagnetic core 6. FIG. 4 illustrates a similar device, although this embodiment does not utilize the pole pieces, and the permanent magnets are shown at 10. In this embodiment, the permanent magnets 10 are shown in parallel planes, which are at an angle to the diametric plane of the toroid. In a further alternate embodiment (not shown) the arrangement of FIG. 4 is utilized, but the permanent magnets 10 are arranged in non-parallel planes.

The embodiments of FIGS. 3 and 4 have been found to be ideal for use as chokes, although their application in specific circuits are not limited to chokes alone. For example, the devices of FIGS. 3 and 4 may not be utilized as inductors or controllers of current, or transformers.

Another alternate embodiment of the invention is presented in FIG. 15. Two core structures 21 and 24 are placed adjacent to one another. Magnetic assemblies are composed of magnet sets 19, 20 and pole pieces 25, and these assemblies are then sandwiched between the two core structures 21 and 24. Each of the six magnetic assemblies are arranged to have opposite polarity to each adjacent magnetic assembly in both horizontal and vertical directions. However, magnetic polarity may be varied according to a given application. Each of the three vertical limbs are enclosed by coils 18, 22, 23, respectively. This particular device is advantageous when used as a power distribution transformer, a power distribution protection device or a current limiting device. The basic theory behind this device has been described according to FIGS. 5, 6, 7, 11, 12, 13 and 14. An additional discovery has been made in which we have found that if the magnetic field is established in the core which is perpendicular to the magnetic field of the permanent magnets, then the hysteresis curve for such a device will also define a smaller area than what would be observed if the perpendicular magnetic field did not exist. Thus, the creation of a magnetic field in the core which is perpendicular to the field created by horizontal pairs of permanent magnets will result in a device with substantially reduced heat generation, and greater energy efficiency. The transformer device of FIG. 15 may be used in three-phase applications and displays the characteristic shown in FIG. 6.

As we described the usefulness of static magnetic biasing in reducing core losses in ferromagnetic materials, we have also set out the principle that the bias field may not be restricted to the conventional direction of flux flow, but may also be used in the "orthogonal direction". Our invention can be extended to AC orthogonal biasing in which further advantages are realized in the application of power transformers.

The advantages of magnetic biasing for reducing hysteresis losses have been demonstrated in FIGS. 11, 12, 13 and 14, however, we have found that many ferromagnetic materials, including ferrites, can be biased in a multidimensional manner as demonstrated in FIG. 16. FIG. 16 illustrates a portion of a ferromagnetic material in which several flux density vectors are imposed. The material will exhibit a maximum flux density vector in the normal direction depicted by the non-linear vector B_norm. Another non-linear flux density vector B_orth may be imposed by a magnet or by a coil, resulting in an overall non-linear flux density vector B_res_O. Although the material may have a magnetic saturation vector of absolute value B_norm, the imposed orthogonal vector B_orth will cause a complex non-linear vector of B_res_o, which exceeds the saturation value.

Due to the non-linear and inter-dependant relationship of the flux vectors described above, the "box" which depicts a two and three dimensional example (FIG. 16) would not in fact have straight lines, as seen in a conventional vector diagram, but would include curved lines.

The significant point of this biasing is that the effective operating flux density of a magnetic device can be raised above the normally accepted values, with the result being improved performance. Thus, the magnetic device can be constructed in a smaller size than is normally used in conventional technology. Since the magnet can be replaced by a coil, AC biasing becomes possible, allowing an orthogonal winding which comprises part of the functional windings of the device/transformer.

FIG. 17 illustrates a practical implementation of such a device. Slots 26 provide space for the windings, but are otherwise not necessary for orthogonal operation. The device shown in FIG. 17 includes a core which is wrapped with orthogonal windings 27, 28. The windings 27 and 28 may consist of several windings for coupled outputs. B_norm and B_orth are shown in the drawing, demonstrating orthogonal flux paths. The scaler addition of B_norm and B_orth will exceed the saturating value of flux of the material, thus exacting and emulating a transformer or magnetic device operating beyond the normal flux operating levels of the material. The net result is lower hysteresis losses and the ability to construct the effective device in smaller sizes for weight reduction.

As can be seen in FIG. 17, limbs 29 conduct flux between the top and bottom sections. On one set of diagonally opposite corners, flux is additive, while on the other, it is opposing. When constructing the device of FIG. 17, the limbs 29 are preferably formed of unequal size.

The biased magnetic core constructions described herein are not limited to the exact configurations described, but may be varied in any manner consistent with the scope of the appended claims.

What is claimed is:

1. A permanent magnetic core device for use as a transformer, inductor, choke, or a component in a current limiting circuit, comprising:

first and second layers of magnetic conductive material retained in a predetermined, spaced apart relationship with respect to one another, so as to define opposed facing surfaces, at least at first and second end portions thereof, and a gap between said layers;

a first permanent magnetic piece located at said first end portion between said first and second layers of ferromagnetic material, and a second permanent magnetic piece located at a second end portion between said first and second layers of magnetic conductive material, the first and second permanent magnetic pieces being placed so that their fields are additive;

a first magnetic pole pieces positioned between the first layer of the magnetic conductive material and a second magnetic pole piece positioned between the second layers of the magnetic conductive material on each side of the respective first and second permanent magnet pieces, and;

coil means surrounding each of said first and second layers of magnetic conductive material, said coil means extending within said gap between said first and second permanent magnetic pieces and being placed so that fields produced by the coil means are additive.

2. The permanent magnetic core device as claimed in claim 1, wherein said coil means comprises one or more coils.

3. The permanent magnetic core device as claimed in claim 2, wherein each of said one or more coils are wrapped around said respective first and second layers of core material.

4. A toroidal permanent magnetic core for use as a transformer, choke or component in a current limiting circuit, comprising:

a first semi-circular toroidal ferromagnetic piece having first and second ends;

a second semi-circular toroidal ferromagnetic piece (6) having first and second ends;

said first and second ends of said first toroidal ferromagnetic piece being arranged to face the first and second ends of said second toroidal ferromagnetic piece, such that the ends of said first and second toroidal ferromagnetic pieces are opposed and spaced apart;

permanent magnets interposed between said ends of said toroidal ferromagnetic pieces and joined with said toroidal ferromagnetic pieces;

at least one pole piece attached to a periphery of said first and second toroidal ferromagnetic pieces; and a coil surrounding a portion of said first toroidal ferromagnetic piece or said second toroidal ferromagnetic piece, said first and second toroidal ferromagnetic pieces and said permanent magnetic pieces defining a closed toroidal structure.

5. The toroidal permanent magnetic core as claimed in claim 4, wherein said permanent magnetic means comprises two spaced-apart permanent magnets.

6. The toroidal permanent magnetic core as claimed in claim 5, wherein said spaced-apart permanent magnets are arranged along a single plane.

7. A toroidal permanent magnetic core for use as a transformer, choke or component in a current limiting circuit, comprising:

a first semi-circular toroidal ferromagnetic piece having first and second ends;

a second semi-circular toroidal ferromagnetic piece having first and second ends;

said first and second ends of said first toroidal ferromagnetic piece being arranged to face the first and second ends of said second toroidal ferromagnetic piece, such that the ends of said first and second toroidal ferromagnetic pieces are opposed and spaced apart;

permanent magnets interposed between said ends of said toroidal ferromagnetic pieces and joined with said toroidal ferromagnetic pieces; said permanent magnets being arranged along parallel planes, and angled with respect to a diametric plane of said toroidal permanent magnetic core;

at least one pole piece attached to a periphery of said first and second toroidal ferromagnetic pieces; and a coil surrounding a portion of said first toroidal ferromagnetic piece or said second toroidal ferromagnetic piece, said first and second toroidal ferromagnetic pieces and said permanent magnetic pieces defining a closed toroidal structure.

8. The toroidal permanent magnetic core as claimed in claim 4, further including a plurality of pole pieces attached to a periphery of said first and second toroidal ferromagnetic pieces.

9. The toroidal permanent magnetic core as claimed in claim 8, wherein said toroidal permanent magnetic core includes an inner periphery and an outer periphery and said plurality of pole pieces are attached to said inner periphery and said outer periphery.

10. The toroidal permanent magnetic core as claimed in claim 4, wherein said toroidal permanent magnetic core includes an inner and outer periphery and said coil is wrapped around portions of said inner and outer peripheries.

11. A multi-phase electrical device for use as a power distribution transformer, a power distribution protection device or a current limiting device, comprising:

a first core structure and a second core structure each of said first core structure and second core structure having a perimeter and at least one vertical limb extending within said perimeter of each core structure;

said first and second core structures being retained in juxtaposition by permanent magnet sets interposed between said first and second core structures, said permanent magnet sets respectively comprising permanent magnet pieces with magnetic pole pieces positioned between each side of the permanent magnet pieces and the respective first and second core structures; and coils surrounding at least a portion of said perimeter, and surrounding at least a portion of said at least one vertical limb;

wherein said first and second core structures and permanent magnet sets form a unit.

12. The multi-phase electrical device as claimed in claim 11, wherein said magnet sets are sandwiched between said first and second core structures.

13. The multi-phase electrical device as claimed in claim 11, wherein said magnet sets comprise a plurality of permanent magnet assemblies positioned adjacent said perimeter.

14. The multi-phase electrical device as claimed in claim 13, wherein each magnet assembly is arranged to have an opposite polarity to other adjacent magnet assemblies.

15. The multi-phase electrical device as claimed in claim 11, wherein a first magnetic field established by the coils is orthogonal to a second field established by the permanent magnet set whereby energy losses and hysteresis losses in said multi-phase electrical device are reduced.

16. The multi-phase electrical device as claimed in claim 15, wherein vectored fluxes produced by said orthogonally arranged coils produce a net flux density that exceeds a predetermined saturation flux density of the permanent magnet sets.

* * * * *